US008899100B2

(12) United States Patent
Russell

(10) Patent No.: US 8,899,100 B2
(45) Date of Patent: Dec. 2, 2014

(54) TESTING PROTOCOL FOR A DOUBLE WALLED TANK

(76) Inventor: David D. Russell, Blodgett, MO (US)

( * ) Notice: Subject to any disclaimer, the term of this patent is extended or adjusted under 35 U.S.C. 154(b) by 213 days.

(21) Appl. No.: 13/308,500

(22) Filed: Nov. 30, 2011

(65) Prior Publication Data

US 2012/0144899 A1 Jun. 14, 2012

Related U.S. Application Data

(60) Provisional application No. 61/418,287, filed on Nov. 30, 2010.

(51) Int. Cl.

| | |
|---|---|
| ***G01M 3/34*** | (2006.01) |
| ***G01M 3/04*** | (2006.01) |
| ***B65D 90/50*** | (2006.01) |

(52) U.S. Cl.

CPC ..... *B65D 90/503* (2013.01)

USPC ..... 73/49.2; 73/49.3

(58) Field of Classification Search

USPC ..... 73/40, 40.5 R, 49.2, 49.3

See application file for complete search history.

(56) References Cited

U.S. PATENT DOCUMENTS

| | | | | |
|---|---|---|---|---|
| 4,442,702 | A | 4/1984 | Sawada | |
| 6,834,534 | B2 * | 12/2004 | Halla et al. | 73/49.2 |
| 7,461,541 | B2 * | 12/2008 | Adams et al. | 73/40.5 R |
| 2004/0149017 | A1 | 8/2004 | Hutchinson et al. | |
| 2004/0182136 | A1 | 9/2004 | Halla et al. | |
| 2005/0126265 | A1 | 6/2005 | Herzog et al. | |

OTHER PUBLICATIONS

International Search Report, International Patent Application No. PCT/US2011/062736, mailed Aug. 14, 2012, 4 pages.

* cited by examiner

*Primary Examiner* — Randy W Gibson
*Assistant Examiner* — Natalie Huls
(74) *Attorney, Agent, or Firm* — Haugen Law Firm PLLP

(57) ABSTRACT

A protocol for testing the integrity of a double-walled underground storage tank.

8 Claims, 2 Drawing Sheets

TESTING PROTOCOL FOR A DOUBLE WALLED TANK

CROSS REFERENCE TO RELATED APPLICATION(S)

This application claims benefit of and priority to U.S. Provisional Patent Application Ser. No. 61/418,287 filed Nov. 30, 2010, the entire disclosure of which is incorporated herein by reference.

BACKGROUND

1. Field of the Invention

This invention relates to the field of testing protocols to verify the integrity of double walled tanks.

2. Description of Related Art

Commercial and industrial liquids of all types are stored in storage tanks. One of the most notable such types of storage is for motor vehicle fuel. For reasons of space, many of these tanks are placed underground to be able to supply filling stations and other places where large amounts of liquids are to be stored and distributed. Underground fuel tanks are generally cylindrical in shape and usually have a capacity in the range of 500 to 20,000 gallons or more. Such tanks are generally made of either metal (usually steel) or a fiber reinforced resinous material to resist the often corrosive nature of the materials stored in them.

Storage tanks also are used in a variety of other situations for the storage of liquids. Tanks can be used in industrial settings for the storage of liquids to be used in manufacturing, can be used as storage for end products prior to shipping, or can be used as part of a manufacturing process. Storage tanks are quite ubiquitous and can store all manner of liquids. They are commonly used for the storage of fuels, water, foods, and valuable chemicals, but also can be used to store waste or raw materials. While most of these tanks are in a generally standard size range, they can range from small sizes of less than 100 gallons, to massive tanks the size of small buildings.

Because the liquids stored in such tanks are often hazardous (gasoline for use as a motor fuel being one of the most common), and thus can cause severe environmental damage and greatly impact the lives of people living, working, and recreating in nearby areas, careful attention to the potential for leaks from such tanks must be exercised. In some cases, even small leakage from such an underground tank can have profound effects as the chemical can serve to poison a local water supply, or lead to a situation where nearby soil or other materials become directly hazardous to life. The fact that many of these storage tanks are in areas of higher population density simply exaggerates the problems.

Due to these potential problems from leaks, safer storage tanks have been designed with a double wall, such that a breach in the integrity of either of the inner or outer wall alone will not allow a leak of the liquid contained in the tank outside of the tank. The use of such double-walled tanks (or equivalents thereof, wherein some sort of secondary containment is provided for an otherwise single-walled tank) is increasingly being mandated by government regulation, particularly when such tanks are placed underground or in places where a leak could potentially contaminate soil, air, or water.

While new tanks can be built to more stringent safety standards, because a large number of tanks have already been placed prior to the rules being imposed and the operation for removing and replacing them can be economically unviable, it is often the case that tanks need to be retrofitted in place to comply with more stringent safety regulations or simply taken out of service, which results in a major waste of resources. In one alternative, a tank structure that provides added safety from the hazards of leaking storage tanks comprises the retrofit of a liner which is installed in a single wall tank that has been in use and is already in the ground or in position for use. Certain of these liners can be installed without removing the tank from its original position. Such a lining can be significantly more economical to install as compared with removal and replacement of the single-walled tank with a new double-walled tank.

In one known arrangement for these retrofit liners, a self-supporting bladder is installed into existing storage tanks, particularly into underground storage tanks. Methods of retrofitting tanks in this manner has been described in U.S. patent application Ser. No. 13/161,346 and U.S. patent application Ser. No. 13/252,858, the disclosure of which is entirely incorporated herein by reference. This self-supporting bladder serves as the inner wall, utilizing the existing tank as the outer wall of a double wall system, or can provide a double wall system through the use of an insert placed therein so that the existing tank is unnecessary to provide for double wall protection.

This self-supporting bladder for the creation of a double-walled tank has numerous benefits in the art of underground storage tank systems. While this method provides for a new primary containment system, allowing the existing tank to act as a secondary containment, the new primary containment is not necessarily structurally equivalent to an independent tank. This difference in the structural integrity of the primary containment system renders the known, traditional protocols for testing the integrity of traditional double-walled and single-walled tanks unacceptable and dangerous. The risk of puncturing or rendering the primary containment system of these self-supporting bladders inoperable through these traditional testing techniques is simply too high. These traditional testing protocols simply do not take into account the difference in structural integrity between the primary containment system and the secondary containment system in these self-supporting bladder structures and, as such, is not useable in these types of double-walled structures. Accordingly there is a need in the art for a protocol to test the integrity of a tank that is compatible and reliable with these double-walled tank structures which is able to detect small leaks in the outer wall, inner liner and ullage areas of a tank while also preventing the significant inadvertent damage to the liner caused by traditional testing protocols.

SUMMARY

Because of these and other problems with the art, described herein, among other things is a testing protocol suitable for a double-walled tank structure. In one embodiment this testing protocol comprises a method for testing the integrity of a double-walled underground storage tank, the method comprising: inspecting a monitor pipe for liquid in an annular space; removing any liquids detected in the annular space; applying vacuum pressure to the annular space; stabilizing the vacuum pressure applied to the annular space; holding the vacuum pressure applied to the annular space for a first time period; if the vacuum pressure applied for the first time period has a vacuum decrease greater than 0.5" Hg, determining the tank fails; if the vacuum pressure applied for the first time period has a vacuum decrease of 0.5" Hg or less then holding the vacuum pressure applied to the annular space for a second longer time period; if at the end of the second longer time period the vacuum level is greater than 2" Hg less than the vacuum pressure applied or the annular space is wet, determining that the tank fails; if at the end of the second longer time period the vacuum level is no more than 2" Hg less than the vacuum pressure applied and the annular space is dry; applying vacuum pressure to an interstice; stabilizing the vacuum pressure applied to the interstice; applying vacuum pressure to a ullage; stabilizing the vacuum pressure applied to the ullage; holding the vacuum pressure applied to the interstice and the ullage for a third period of time; if at the end of the third time period the vacuum pressure applied to the interstice and the ullage remains substantially constant, determining the tank passes; otherwise determining the tank fails.

In one embodiment of this method, the vacuum pressure of said step of stabilizing the vacuum pressure applied to the annular space is stabilized at or above 10" Hg.

In another embodiment of this method, the first time period is 5 minutes or longer.

In yet another embodiment of this method, the second longer time period is one hour.

In still another embodiment of this method, the vacuum pressure of said step of applying vacuum pressure to an interstice is 10" Hg.

In another embodiment of this method, the vacuum pressure of said step of applying vacuum pressure to an ullage is 1" Hg.

In another embodiment of this method, the third time period is 1 hour or less.

In another embodiment of this method, the method is repeated if a tank failure is determined.

DETAILED DESCRIPTION OF PREFERRED EMBODIMENTS

Figure 1:
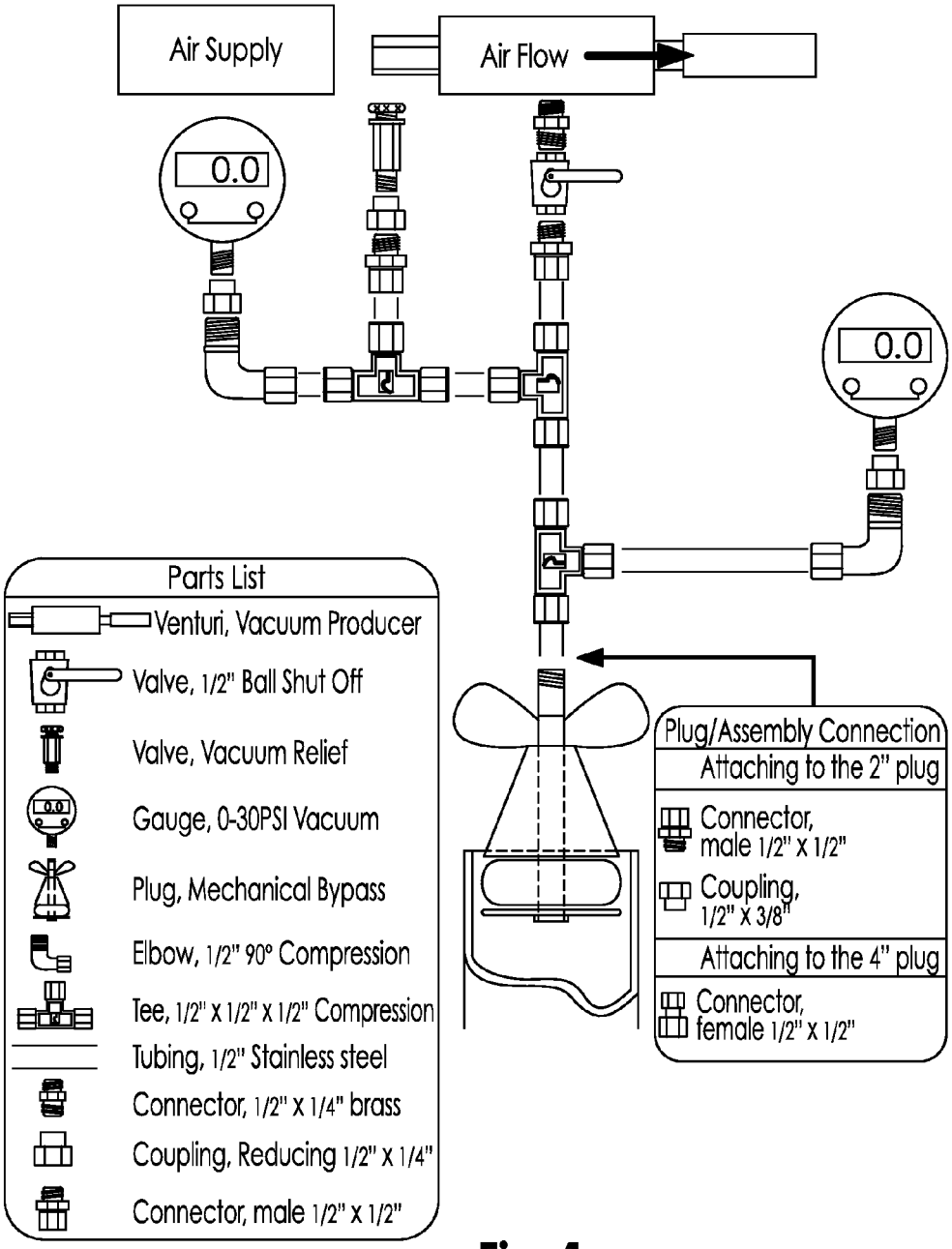
FIG. 1 provides a diagram of the vacuum device used in the testing protocol for double-walled tanks.
Figure 2:
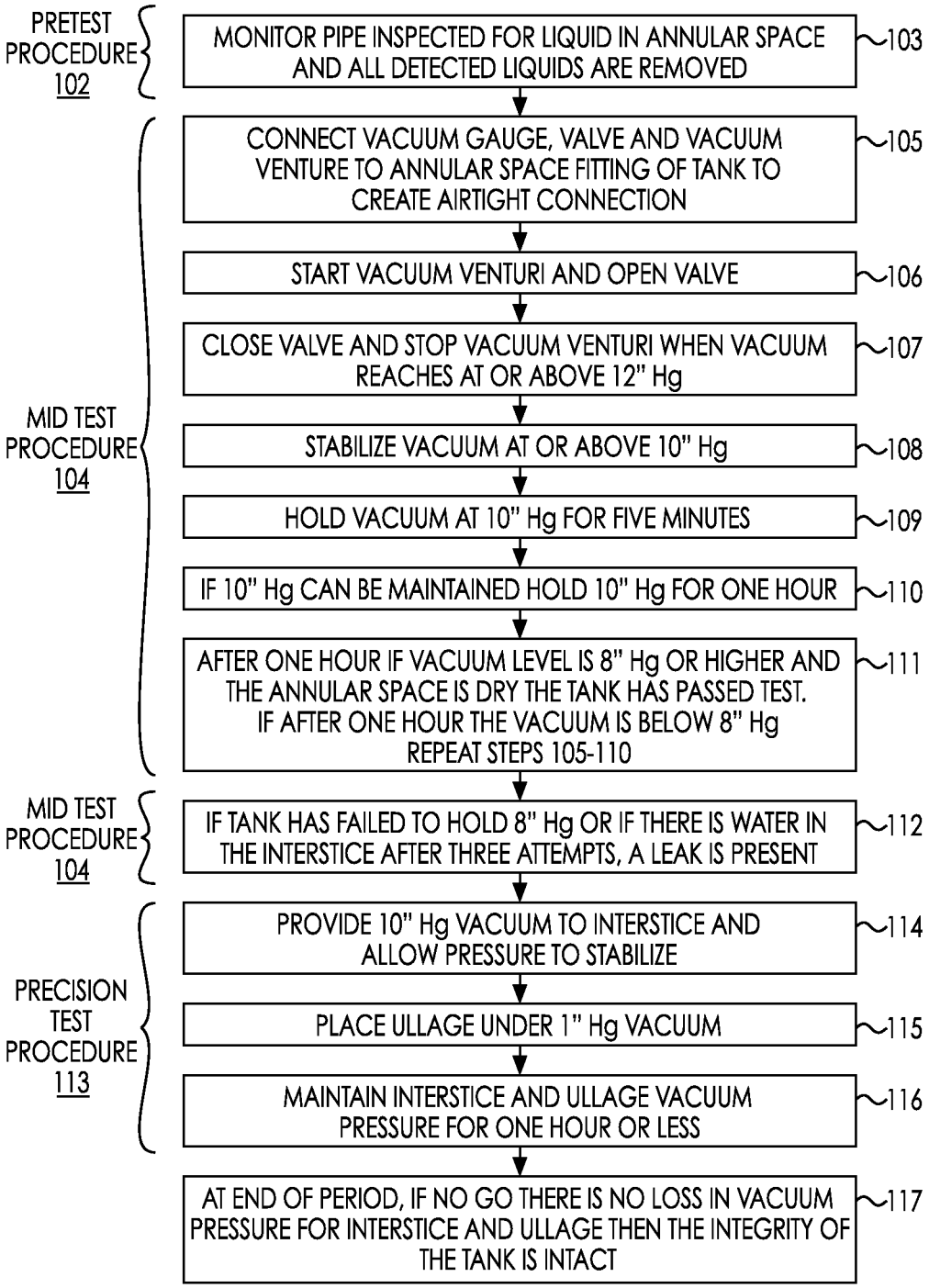
FIG. 2 provides a flow chart of the steps of an embodiment of the testing protocol for a double-walled tank.

Embodiments of a testing protocol suitable for a double-walled tank liner are described with respect to FIGS. 1-2. As a preliminary manner, it is noted that the testing protocol (101) of this application will be described as being used for a double-walled tank created by a self-supporting bladder. However, it should be understood that this description is not limiting. It is contemplated that the testing protocol (101) described herein may be utilized to test the integrity of any double-walled or other multi-walled underground tank system known to those of ordinary skill in the art. Further, it is also contemplated that the testing protocol described herein may be utilized with single-walled underground storage tanks.

Generally, the equipment required for the testing protocol described herein consists of the following components, as demonstrated in FIG. 1. First, a vacuum gauge known to those of ordinary skill in the art. In one embodiment, a vacuum gauge with a range of 0-30" Hg with increments of 0.2" Hg or smaller will be utilized. Second, a venturi known to those of skill in the art. In one embodiment, an air driven venturi capable of pulling about 15" Hg when operated with compressed air is contemplated. Third, a valve and an air house. In one embodiment, a vacuum relief valve is contemplated. Fourth, a vacuum regulator or automatic shut-off valve is contemplated. Generally, a regulator or shut-off valve that will shut-off at 12" Hg is contemplated. In one embodiment, a ½" ball shut off valve will be utilized.

In general, the testing protocol (101) described herein requires a vacuum to be drawn on a tank interstitial space (i.e., the space between the primary containment system and the secondary containment system) ullage and tank monitor pipe for a period of time. The testing protocol (101) takes into account that vacuums known to those of ordinary skill in the art are expected to decay over time. It does so by recognizing an acceptable change in the vacuum level based upon the tank's size, type, the amount of fluid in the tank and the backfill conditions. For example, in one embodiment the testing protocol procedure will require an initial vacuum of 10" Hg for the monitor pipe during the initial hold time and a maximum vacuum loss of 2" Hg. In this embodiment, if the vacuum loss exceeds 2" Hg during the hold time, the test will be repeated.

The first portion of the testing protocol (101) described herein is the pretest procedure (102). In one embodiment of this pretest procedure (102), the monitor pipe will be inspected (103) for liquid in the annular space and all detected liquids will be removed rendering the monitoring pipe completely dry. In one embodiment of this inspection step (103), a flashlight will be utilized to visually inspect the tank via the monitoring pipe to ascertain if there is liquid in the bottom of the monitoring pipe. In another embodiment of this inspection step, a tank stick with an absorbent firmly attached to its bottom will be utilized instead of a flashlight. If liquid is found in this inspection step, a determination is made whether the liquid is water or fuel. If it is fuel, a determination is attempted as to whether the fuel came from an overfill condition or, rather, if it came from some other source. If no cause is found for the presence of the fuel in the monitoring pipe, then a leak in the primary tank should be anticipated. If, rather, the liquid is determined to be water, then a determination is made if the water could be from a leak associated with the monitoring system. If no cause is found for the presence of the water in the monitoring tube, then a leak in the secondary tank should be anticipated. After these determinations are made, all the liquid is removed from the monitoring pipe rendering the monitoring pipe completely dry.

In the cases of the pretest procedure (102) inspection (103) step where a user is unable to determine if the annular space of the monitor pipe is free of vapors and liquid, the testing protocol (101) will proceed without this determination.

The second portion of the testing protocol (101) described herein is the mid-test procedure (104). Generally, in the mid-test procedure, a vacuum is applied to the interstitial space and held for a period of time to draw any fluid from a breach in the integrity of the double-walled tank (if there is one) into the interstitial space. For example, a vacuum pressure at a certain Hg is applied to the annular space filing of the tank for a certain defined period of time. In one embodiment, a vacuum level of about 10" Hg will be held for one (1) hour. While one hour is contemplated in this embodiment, it should be noted that the period of hold time can range anywhere from twenty (20) minutes to five (5) hours, depending upon the embodiment. Further, while a vacuum level of about 10" Hg is contemplated in this embodiment, in other embodiments a vacuum pressure of less than or equal to about 15" Hg may be utilized. If at the end of the hold time the vacuum level has decreased by only about 2" Hg or less and the annular space is dry, the tank has passed the testing protocol. If the pressure in the tank decreases by more than 2" Hg after the specified period of time, the hold is repeated. If, after three attempts the tank continues to decrease by more than 2" Hg after each hold or if there is water in the interstice it is deemed that there is a breach in the integrity of the tank.

Further, a leak can be determined in this mid-test procedure (104) by monitoring the stability of the vacuum level. The vacuum level is allowed to stabilize at a certain predefined Hg. In one embodiment, this predefined Hg will be a stabilized Hg of at or about 10" Hg. Once stabilized, the vacuum level will be held for a predetermined period of time known to one of ordinary skill in the art. In one embodiment, this predetermined period of time will be about 5 minutes. If, during this set period of time, a stable vacuum cannot be maintained, a leak in the tank is indicated and the test is terminated. Maintenance of a stable vacuum is defined as holding the defined stabilized Hg with a decrease in Hg of about 0.5" or less.

In one embodiment of the testing protocol (101) of this application, the mid test procedure (104) proceeds as follows. In a first step (105), the vacuum gauge, valve and vacuum venture are connected to an annular space fitting of a tank to create an airtight connection as provided in FIG. 1. In one embodiment, the valve is between the compressor and the fitting and the gauge is between the valve and the fitting so it will read when the valve is closed. In this embodiment, an automatic shut-off valve is utilized and it is set at about 12"Hg.

In the second step of this embodiment (106), the vacuum venturi is started and the valve is opened. In the third step of this embodiment (107) when the vacuum reached at or above about 12" Hg, the valve is closed and the vacuum venturi is stopped. In the fourth step of this embodiment (108), a user waits until the vacuum level stabilizes at or above 10" Hg. In a sixth step of this embodiment (109), the vacuum level is held for five (5) minutes or longer at 10" Hg with a vacuum decrease of 0.5" Hg or less. If this cannot be maintained, a leak in the tank is indicated and the test is terminated. If this can be maintained then, in a seventh step (110), the initial vacuum level of about 10" Hg is held for about an hour. In an eighth step (111), if, after the hour hold, the vacuum level is 8" Hg or higher and the annular space is dry, the tank is deemed to have passed the test, there is no breach in the integrity of the tank. If in the eighth step (111), after the one hour hold, the vacuum level is below 8" Hg the hold is repeated. If in a ninth step (112) of the embodiment, the tank has failed to hold 8" Hg or if there is water in the interstice after three attempts, a leak is determined to be present.

The third portion (113) of the testing protocol described herein is the precision test of the complete tank. This third portion of the precision test will generally be performed when the tank contains liquid. In this portion of the test, the interstice and the ullage area of the tank are placed under a vacuum. Because the primary tank may be put at high risk above certain differential pressures, the vacuum pressure on the ullage that will be utilized in this portion of the test will be about 1" Hg or less. Further, when the primary tank space is not under vacuum, the overall forces on the tank are no different from those that the tank would normally experience in high water table condition. Therefore, all of the testing of the interstitial space in this third portion (113) of the testing protocol will be performed at a vacuum of about 10" Hg.

In one embodiment, the third portion (113) of the testing protocol will proceed as follows. In a first step (114), the interstice will receive about a 10" Hg vacuum and be given a period of time to allow stabilization of this vacuum pressure. In a second step (115), once the interstice vacuum is stabilized the ullage is placed under a 1" Hg vacuum. In a third step (116), the interstice vacuum and the ullage vacuum will be maintained for a period of one (1) hour or less. In a third step (117), at the end of the period, if the gauges for the interstice and ullage vacuum remain constant with no loss of vacuum for the test period, it is determined that the integrity of the tank is intact.

While the invention has been disclosed in conjunction with a description of certain embodiments, including those that are currently believed to be the preferred embodiments, the detailed description is intended to be illustrative and should not be understood to limit the scope of the present disclosure. As would be understood by one of ordinary skill in the art, embodiments other than those described in detail herein are encompassed by the present invention. Modifications and variations of the described embodiments may be made without departing from the spirit and scope of the invention.

The invention claimed is:

1. A method for testing the integrity of a double-walled underground storage tank, the method comprising:

inspecting a monitor pipe for liquid in an interstice;

removing any liquids detected in the interstice;

applying a specific vacuum pressure to the interstice;

stabilizing the vacuum pressure applied to the interstice;

holding the specific vacuum pressure applied to the interstice for a first time period;

if the specific vacuum pressure applied for the first time period has a vacuum decrease greater than 0.5" Hg, determining the tank fails;

if the specific vacuum pressure applied for the first time period has a vacuum decrease of 0.5" Hg or less then holding the current vacuum pressure applied to the interstice for a second longer time period;

if at the end of the second longer time period the vacuum level is greater than 2" Hg less than the vacuum pressure applied or the interstice is wet, determining that the tank fails;

if at the end of the second longer time period the vacuum level is no more than 2" Hg less than the vacuum pressure applied and the interstice is dry;

applying a new vacuum pressure to the interstice;

stabilizing the vacuum pressure applied to the interstice;

applying a new vacuum pressure to a ullage;

stabilizing the vacuum pressure applied to the ullage;

holding the vacuum pressure applied to the interstice and the ullage for a third period of time;

if at the end of the third time period the vacuum pressure applied to the interstice and the ullage remains substantially constant, determining the tank passes;

otherwise determining the tank fails.

2. The method of claim 1, wherein the vacuum pressure of said step of stabilizing the vacuum pressure applied to the interstice is stabilized at or above 10" Hg.

3. The method of claim 1, wherein the first time period is 5 minutes or longer.

4. The method of claim 1, wherein the second longer time period is one hour.

5. The method of claim 1, wherein the vacuum pressure of said step of applying said new vacuum pressure to an interstice is 10" Hg.

6. The method of claim 1, wherein the vacuum pressure of said step of applying said new vacuum pressure to an ullage is 1" Hg.

7. The method of claim 1, wherein the third time period is 1 hour or less.

8. The method of claim 1 wherein the method is repeated if a tank failure is determined.

* * * * *